US009149670B1

(12) United States Patent
Walker et al.

(10) Patent No.: US 9,149,670 B1
(45) Date of Patent: Oct. 6, 2015

(54) LANYARD INTERLOCK ASSEMBLY

(71) Applicant: Altec Industries, Inc., Birmingham, AL (US)

(72) Inventors: Elizabeth K. Walker, Wake Forest, NC (US); Robert J. Crowder, Wake Forest, NC (US); Benjamin J. Southern, Wake Forest, NC (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 14/485,044

(22) Filed: Sep. 12, 2014

(51) Int. Cl.

| | |
|---|---|
| ***E04G 3/00*** | (2006.01) |
| ***E04G 1/00*** | (2006.01) |
| ***A62B 35/00*** | (2006.01) |
| ***B66F 5/04*** | (2006.01) |

(52) U.S. Cl.
CPC ..... *A62B 35/0068* (2013.01); *A62B 35/0043* (2013.01); *B66F 5/04* (2013.01)

(58) Field of Classification Search
CPC .. A62B 35/00; A62B 35/005; A62B 35/0056; A62B 35/0087; A62B 35/0068; A62B 35/0043; A62B 35/0037; A62B 27/00; B66F 5/04; Y10T 403/16; Y10T 403/1608; F16B 2001/0092
USPC ..... 701/112; 200/51.09; 403/315, 316
See application file for complete search history.

(56) References Cited

U.S. PATENT DOCUMENTS

| | | | |
|---|---|---|---|
| 6,265,983 | B1 | 7/2001 | Baillargeon |
| 6,405,114 | B1 | 6/2002 | Priestley et al. |
| 2011/0259215 | A1 | 10/2011 | Van Doaran et al. |
| 2012/0160604 | A1 | 6/2012 | Bowden |
| 2013/0153335 | A1 | 6/2013 | Luminet et al. |

FOREIGN PATENT DOCUMENTS

| | | | |
|---|---|---|---|
| WO | 2013/093395 | A1 | 6/2013 |

*Primary Examiner* — Katherine Mitchell
*Assistant Examiner* — Shiref Mekhaeil
(74) *Attorney, Agent, or Firm* — Erise IP, P.A.

(57) ABSTRACT

A machine operator safety system for selectively providing hydraulic power to a boom assembly of an aerial device upon attaching a lanyard. The machine operator safety system comprises a set of upper boom controls within the utility platform, a lanyard anchor housing with a lanyard anchor therein, an actuator for selectively positioning the lanyard anchor housing in either a first position or a second position, and a hydraulic valve. When the lanyard anchor housing is in the first position, which conceals the lanyard anchor, the hydraulic valve blocks the flow of hydraulic power to the set of upper boom controls. When the lanyard anchor housing is in the second position, which exposes the lanyard anchor for attachment of the lanyard, the hydraulic valve directs the flow of hydraulic power to the set of upper boom controls.

20 Claims, 8 Drawing Sheets

LANYARD INTERLOCK ASSEMBLY

BACKGROUND

1. Field

Embodiments of the invention relate to utility platform safety. More particularly, embodiments of the invention relate to systems for ensuring a worker is secured to a utility platform before providing hydraulic power to a boom.

2. Related Art

Utility workers utilize an aerial device to reach inaccessible locations. The aerial device is usually mounted on a utility truck and generally includes a boom with a utility platform connected to a distal end of the boom. The utility platform includes a platform in which one or more utility workers stand. As such, aerial devices include systems for mitigating a risk the utility worker can fall from the utility platform. Aerial device operators utilize a lanyard, which is securely attached to the worker, and a lanyard anchor, which is securely attached to the aerial device. In the event a worker does fall from the utility platform, the lanyard and lanyard anchor prevent the worker from falling all the way to the ground. To ensure safety, some utility platforms utilize a system that electrically detects the presence of one or more lanyards before allowing the operation of the utility platform.

Utility workers typically use an aerial device to access overhead electric power lines and electric power components for installation, repair, or maintenance. The utility platforms utilized by electric utility workers are highly insulated so as to prevent the discharge of electricity through the utility truck, and especially through the utility worker. The insulated nature of the utility platform prevents the use of a system that detects the attachment of a lanyard to a lanyard anchor via electrical signals. Not only does the insulated nature prevent the operation, but adding an electrical signal system of detecting the lanyard could potentially be unsafe to the utility worker. As such, there is currently no system or method of ensuring that a utility worker has attached his lanyard to the utility platform.

SUMMARY

Embodiments of the invention solve the above-mentioned problems and provide a distinct advance in the art by selectively providing hydraulic power to a boom only when a lanyard anchor housing is depressed. The operator cannot move the boom via a set of boom controls until the operator's lanyard is actively depressing the lanyard anchor housing. This provides a reminder to the operator to attach the lanyard, which is secured to the operator.

One embodiment of the invention may provide a machine operator safety system. The machine operator safety system selectively provides hydraulic power to a boom assembly of an aerial device upon attaching a lanyard. The machine operator safety system comprises a set of upper boom controls within the utility platform, a lanyard anchor housing with a lanyard anchor therein, an actuator for selectively positioning the lanyard anchor housing in either a first position or a second position, and a hydraulic valve. When the lanyard anchor housing is in the first position, which conceals the lanyard anchor, the hydraulic valve blocks the flow of hydraulic power to the set of upper boom controls. When the lanyard anchor housing is in the second position, which exposes the lanyard anchor for attachment of the lanyard, the hydraulic valve directs the flow of hydraulic power to the set of upper boom controls.

Another embodiment of the invention may provide a lanyard interlock assembly. The lanyard interlock assembly is adapted to be installed into a utility platform of an aerial device and to selectively provide hydraulic power to a boom assembly of the aerial device.

Still another embodiment of the invention may provide a method for ensuring operator safety. The method comprises the steps of providing at least one lanyard interlock assembly in the utility platform, instructing the operator to secure a lanyard to himself, instructing the operator to secure the lanyard to the at least one lanyard interlock assembly, and instructing the operator to remain secured during the operation of the utility platform.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
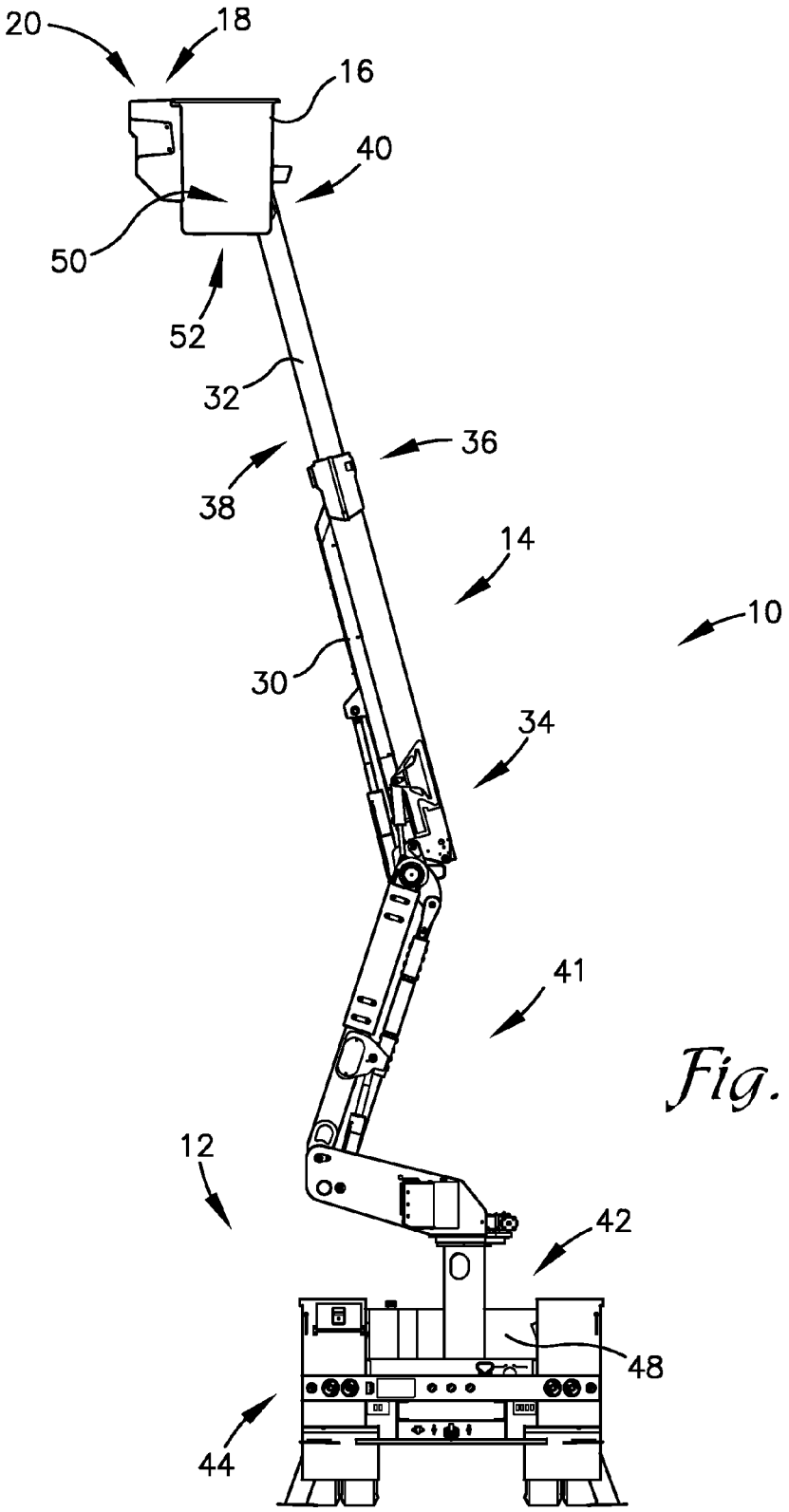
FIG. 1 is an environmental view of a utility truck with a boom assembly and utility platform attached.

The drawing figures do not limit the invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 2:
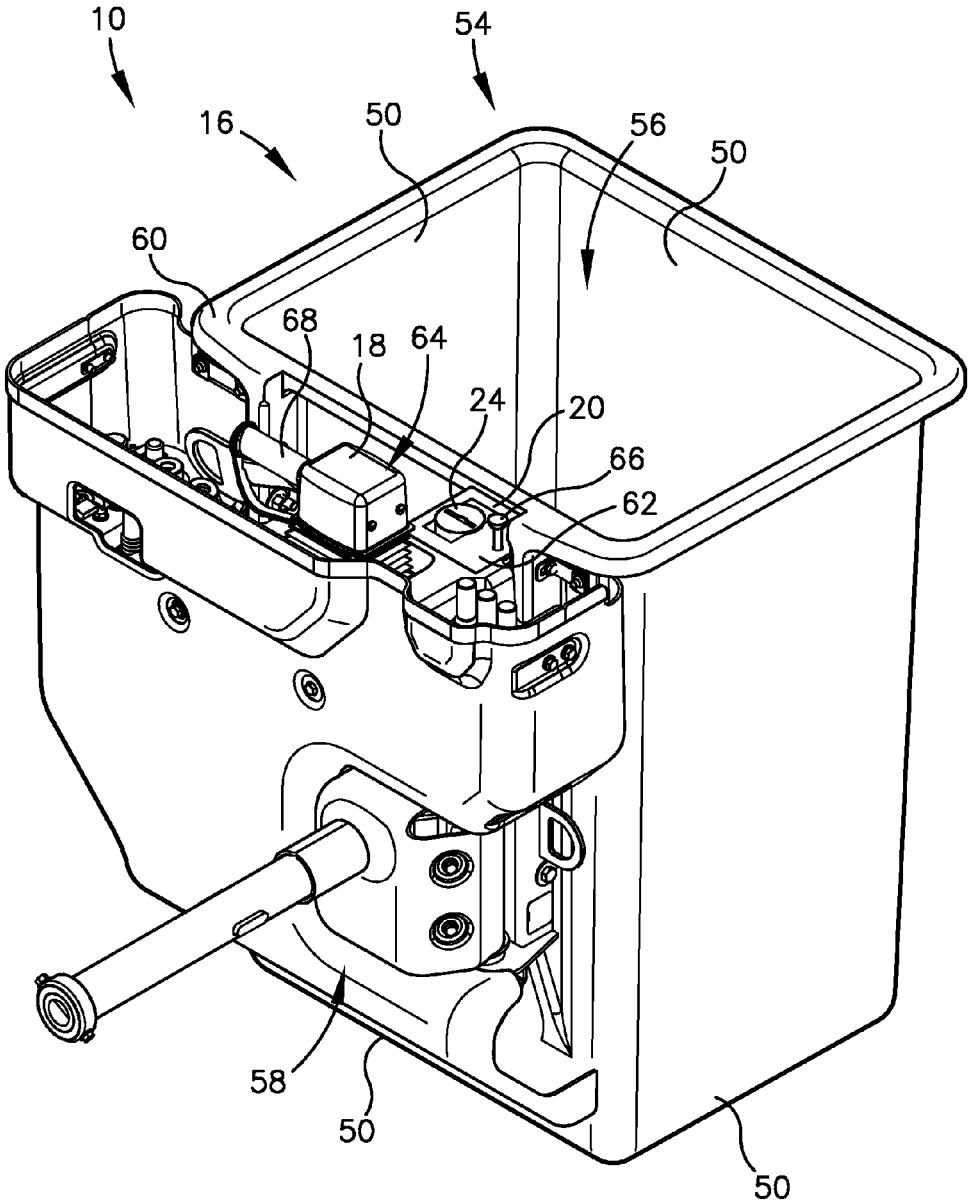
FIG. 2 is a perspective, fragmentary view of the utility platform from FIG. 1 with the boom assembly detached, showing the lanyard interlock.

A machine operator safety system 10, constructed in accordance with various embodiments of the invention is shown in FIGS. 1-2. The system broadly comprises a base 12, a boom assembly 14, a utility platform 16 with a set of upper boom controls 18 therein, and a lanyard interlock assembly 20. The lanyard interlock assembly 20 comprises a lanyard anchor 22, a lanyard anchor housing 24 around the lanyard anchor 22, an actuator 26 for selectively positioning the lanyard anchor housing 24 in either of two positions, and a hydraulic valve 28 for selectively providing hydraulic power to the boom controls.

In embodiments of the invention, the boom assembly 14 comprises a first boom section 30 and a second boom section 32. The first boom section 30 is a hollow, elongated member that presents a proximal end 34 and a distal end 36. The first boom section 30 is rotatably and/or pivotably coupled to the base 12 at the proximal end 34 of the first boom section 30. The first boom section 30 can be formed of an electrically-resistant polymer, such as fiberglass, a metal, or another material. The second boom section 32 is at least partially disposed within the distal end 36 of the first boom section 30 and telescopes to extend or retract relative to the first boom section 30. The second boom section 32 is an elongated member that presents a proximal end 38 and a distal end 40. The second boom section 32 is formed of an electrically-resistant polymer, such as fiberglass, metal, or another material.

As illustrated in FIG. 1, some embodiments of the boom assembly 14 may further comprise at least one pivoting boom section 41. The pivoting boom section 41 does not telescope out of any other boom section. Instead the pivoting boom section 41 rotates about the base 12, and the first boom section 30 pivots and/or rotates relative to the pivoting boom section 41. The use of the pivoting boom section 41 allows the utility platform 16 to reach certain areas and avoid obstacles in the working environment.

In other embodiments of the invention, the boom assembly 14 comprises a single boom section (not illustrated). In still other embodiments of the invention, the boom assembly 14 comprises a first boom section 30, a second boom section 32, and a third boom section that telescopes within the second boom section 32 (not illustrated).

The base 12 comprises an aerial device 42, such as a utility truck. In other embodiments of the invention, the base 12 comprises a stationary structure, such as a tripod.

The boom assembly 14 is extended, retracted, rotated, and pivoted via a set of lower boom controls 44. The set of lower boom controls 44 is disposed on or near the base 12. In embodiments of the invention, the set of lower boom controls 44 is disposed externally to the aerial device 42, such that an operator 46 stands on the ground or an exterior platform to manipulate the set of lower boom controls 44. In other embodiments, the set of lower boom controls 44 is located in a cab 48 of the aerial device 42, such that the operator 46 sits or stands in the cab 48 to manipulate the set of lower boom controls 44.

The set of lower boom controls 44 manipulates a plurality of hydraulic valves (not illustrated), which in turn manipulate the boom assembly 14 to move in a desired direction. In other embodiments, the set of lower boom controls 44 manipulates a plurality of pneumatic valves, which in turn manipulate the boom assembly 14 to move in a desired direction. In still further embodiments, the set of lower boom controls 44 sends a series of electrical signals that manipulate the hydraulic valves. In embodiments of the invention, the set of lower boom controls 44 comprises manual hydraulic valves in which the operator 46 is manually opening and closing hydraulic valves, a joystick (not illustrated) in which the movement of the joystick is translated into hydraulic valve opening and closing with the assistance of a power source, inputs into a computer which directs the opening and closing of hydraulic valves, or any combination thereof.

The utility platform 16 is a bucket or "cherry picker" that couples to the distal end 40 of the second boom section 32. In embodiments of the invention, the utility platform 16 comprises four bucket sidewalls 50 and a bucket floor 52 that form a cavity 54 and present an interior segment 56 and an exterior segment 58. The operator 46 stands in the cavity 54 to perform work. The platform may further comprise a bucket lip 60. There may be enough space within the platform for the operator 46 to walk around, as well as store tools or supplies. The utility platform 16 may further comprise a door in at least one of the bucket sidewalls 50 to allow for ingress and egress of the operator 46. In other embodiments of the invention, the utility platform 16 is a basket that comprises a handrail and a kick plate (not illustrated).

In embodiments of the invention, the utility platform 16 remains substantially level regardless of the position of the boom assembly 14. In other embodiments, the operator 46 manipulates a set of upper controls, discussed below, to manipulate the utility platform 16 into the flat position.

Figure 11:
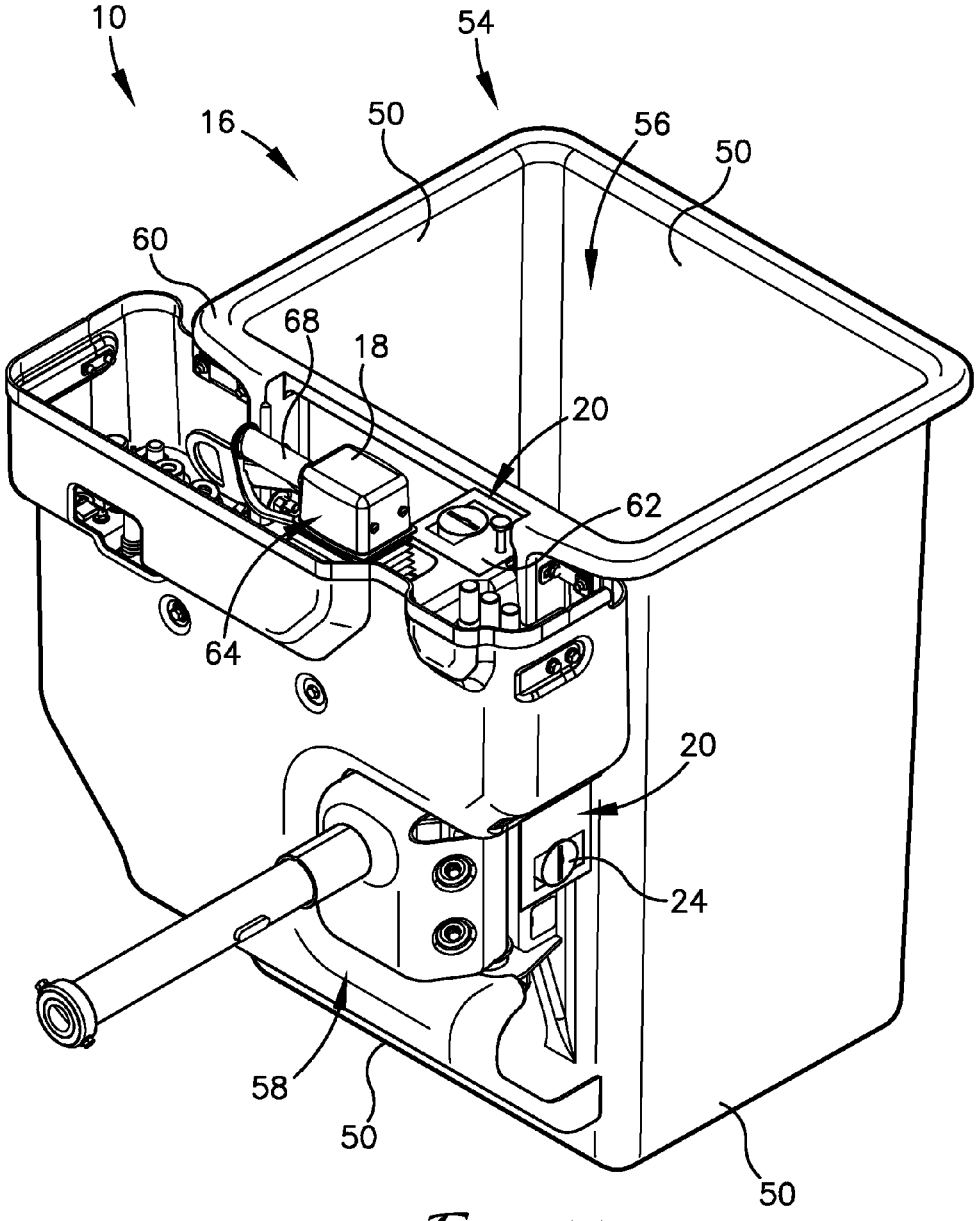
FIG. 11 is a perspective view of the utility platform with two lanyard interlocks.

The four bucket sidewalls 50 of the utility platform 16 may be successively coupled to one another to form the interior segment 56 with a horizontal cross-section that is substantially rectangular. Thus, two of the opposing bucket sidewalls 50 may have a greater width than the other two opposing bucket sidewalls 50. In other embodiments, the four bucket sidewalls 50 may form the interior segment 56 with a horizontal cross-section that is substantially square. The bucket floor 52 is coupled to at least one of the four bucket sidewalls 50. In embodiments of the invention, the bucket lip 60 is coupled to at least one of the four bucket sidewalls 50. Although the dimensions of the platform 16 may vary widely, an exemplary platform for one operator 46 has a horizontal cross-section of approximately 24 inches by approximately 30 inches and has a height of approximately 42 inches, as illustrated in FIGS. 2 and 11. An exemplary platform for two operators has a horizontal cross-section of approximately 24 inches by approximately 48 inches and has a height of approximately 42 inches.

The set of upper boom controls 18 allows the operator 46 to move the boom assembly 14 from within the utility platform 16. The operator 46 in the bucket 16 has a better vantage point to know where and how to position the boom assembly 14 as opposed to the operator 46 on the ground. Additionally, the set of upper boom controls 18 promotes efficiency by allowing the operator 46 to directly control the movement of the boom assembly 14. In embodiments of the invention, an assistant operator (not illustrated) can access the lower boom controls 44 for the duration of the operator 46 being in the utility platform 16. This provides a safety backup to allow the assistant operator to remove the operator 46 from a dangerous situation should the operator 46 become incapacitated or there be a failure in the set of upper boom controls 18. The set of upper boom controls 18 may utilize the same or a different mechanism from the set of lower boom controls 44.

The set of upper boom controls 18 comprises a dash cover 62 and at least one input 64. In various embodiments of the invention, the input 64 can be a valve handle 66, a joystick 68, a button (not illustrated), a switch (not illustrated), or a combination thereof. The dash cover 62 is generally flat or arcuate and presents at least one opening 70. Each of the at least one opening 70 is situated around each of the at least one input 64. The dash cover 62 may additionally contain written instructions and safety information. In embodiments of the invention, the dash cover 62 further comprises the lanyard interlock assembly 20.

The lanyard interlock assembly 20 comprises the lanyard anchor 22, the lanyard anchor housing 24, the actuator 26 for positioning the lanyard anchor housing 24 in either of two positions, and the hydraulic valve 28 for selectively providing hydraulic power to the set of upper boom controls 18. An "interlock" is a safety device that prevents an undesired state in a machine or apparatus. Typically, the undesired state is one in which the machine or apparatus could potentially, or does actually, harm or kill the operator 46 or other person. In this application, the undesired state is one in which the operator 46 is utilizing the set of upper boom controls 18, and thereby moving the boom assembly 14, without being secured to the utility platform 16. To prevent the undesired state, the machine operator safety system 10 requires the operator 46 to place and keep the lanyard interlock assembly 20 into the second position before allowing hydraulic power to the set of upper boom controls 18.

The lanyard anchor 22 is securely coupled to the interior segment 56 or exterior segment 58 of the cavity 54 of the utility platform 16. The lanyard anchor 22 is formed of a metal or hardened polymer. In embodiments of the invention, the lanyard anchor 22 is substantially ring-shaped. In other embodiments of the invention, the lanyard anchor 22 is a hole or an opening (not illustrated) in a portion of the utility platform 16. In still further embodiments, the lanyard anchor 22 is a bar or post (not illustrated) that traverses a recess, void, or depression in a portion of the utility platform 16.

Figure 3:
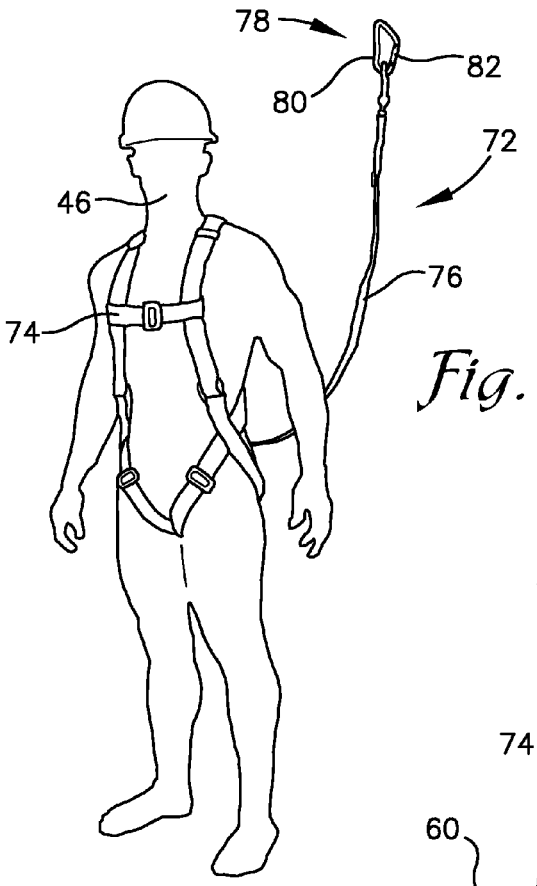
FIG. 3 is a frontal view of an operator wearing a harness.
Figure 4:
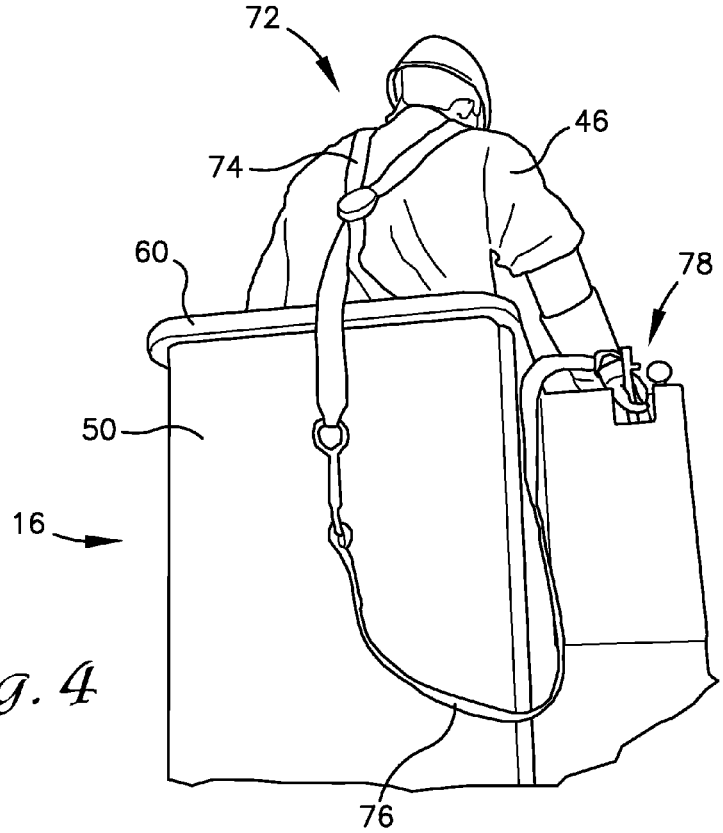
FIG. 4 is a rear view of the operator wearing the harness standing in the utility platform.

A lanyard 72 is attached to the lanyard anchor 22 by the operator 46. As illustrated in FIGS. 3-4, the lanyard 72 comprises a harness 74, a safety line 76, and a carabiner 78. The harness 74 is worn by the operator 46. In embodiments of the invention, the harness 74 is worn externally, such as one worn by a rock climber or repeller. In other embodiments, the harness 74 is integrated into the clothing of the operator 46. The harness 74 securely holds portions of the operator 46 by tightly surrounding these portions of the operator 46. The harness 74 may securely hold the operator's legs, waist, chest, shoulders, or a combination thereof. The harness 74 is typically formed of nylon webbing or other sturdy material, and may include a padding material for the comfort of the wearer.

The safety line 76 of the lanyard 72 extends from the harness 74. In embodiments of the invention, the harness 74 and the safety line 76 are integrally coupled to form a single unit. In other embodiments, the safety line 76 is tied or otherwise removably attached to the harness 74. The safety line 76 is typically formed of nylon webbing, rope, or other sturdy material. The safety line 76 is long enough to allow the operator 46 to move around the utility platform 16 and perform the required task. However, the safety line 76 is short enough to prevent tangling and long falls by the operator 46.

The carabiner 78 of the lanyard 72 comprises a ring 80 and a gate 82 and is adapted for attaching the lanyard 72 to the lanyard anchor 22. The carabiner 78 presents an overall oval shape, D-shape, tear-drop shape, or asymmetrical shape. The ring 80 is formed of a metal and presents an appreciable thickness about its vertical cross-section about the width. The cross-section of the ring 80 can be generally round, rectangular, oval-shaped, or elliptical. The gate 82 of the carabiner 78 is rotatably coupled to an edge of the ring 80 and sits against another edge of the ring 80 in the closed position, such that they carabiner 78 presents a continuous loop in the closed position. In embodiments, the gate 82 of the carabiner 78 has a similar cross-sectional size and shape as the gate 82. In other embodiments, the gate 82 is formed of a hardened wire such that it provides a minimal cross-section. In still other embodiments, the gate 82 is integrally, but deformably, coupled to the ring 80.

The gate 82 of the carabiner 78 opens to allow attachment to the lanyard anchor 22. The gate 82 of the carabiner 78 also closes around the lanyard anchor 22 to secure the lanyard 72, and by extension the operator 46 wearing the lanyard 72, to the lanyard anchor 22. The carabiner 78 selectively remains in the closed position to prevent unintentional disengagement from the lanyard anchor 22. In embodiments of the invention, a spring (not illustrated) generates a force that keeps the gate 82 in the closed position. In other embodiments of the invention, the gate 82 remains closed through a locking mechanism (not illustrated). In another embodiment, the gate 82 remains in the closed position through both a spring and a locking mechanism.

In other embodiments of the invention, the lanyard 72 comprises the harness 74, two safety lines 76, and two carabiners 78. Each of the safety lines 76 is attached to the harness 74. In one embodiment, the first carabiner 78 and the second carabiner 78 are attached to a single lanyard anchor 22. In another embodiment, each carabiner 78 is attached to a separate lanyard anchor 22. An exemplary embodiment with two lanyard anchors 22 is illustrated in FIG. 11.

Figure 5:
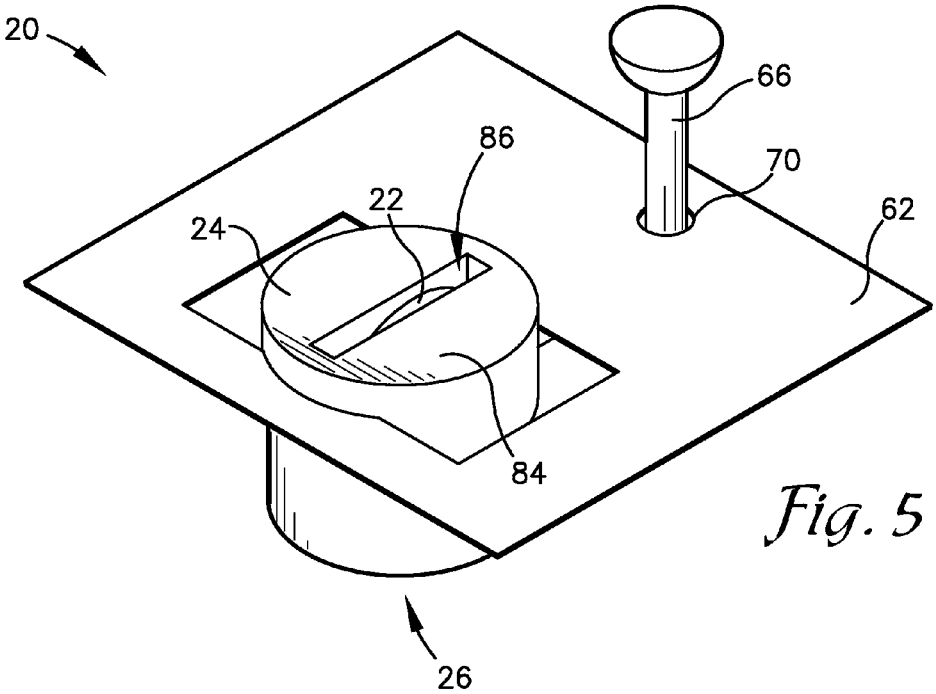
FIG. 5 is a perspective view of the lanyard interlock from the utility platform of FIG. 2, with the lanyard anchor housing being shown in a first position, concealing the lanyard anchor.
Figure 6:
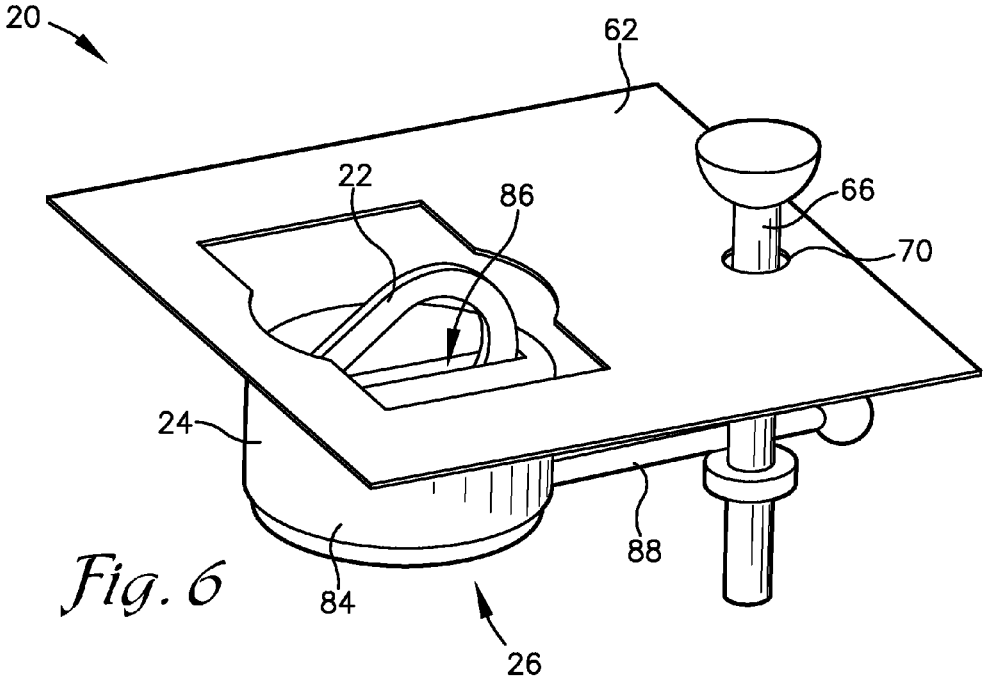
FIG. 6 is a perspective view of the lanyard interlock of FIG. 5, with the lanyard anchor housing being shown in a second position, exposing the lanyard anchor.

The lanyard anchor housing 24 surrounds the lanyard anchor 22. The lanyard anchor housing 24 is adapted to be selectively positioned to at least a first position and a second position. The lanyard anchor housing 24 is coupled to the hydraulic valve 28, discussed below, such that shifting the lanyard anchor housing 24 position corresponds to shifting the hydraulic valve position. In the first position as shown in FIG. 5, which is the default position, the lanyard anchor housing 24 surrounds the lanyard anchor 22 so as to prevent attachment of the lanyard 72 by the operator 46. In the first position, the hydraulic valve 28 prevents the flow of hydraulic fluid, and therefore hydraulic power, to the set of upper boom controls 18. In the second position as shown in FIG. 6, the lanyard anchor housing 24 exposes the lanyard anchor 22 for attachment of the lanyard 72 by the operator 46. In the second position, the hydraulic valve 28 allows the flow of hydraulic fluid, and therefore hydraulic power, to the set of upper boom controls 18. It should be noted that in embodiments of the invention the set of lower boom controls 44 retains hydraulic power regardless of the position of the lanyard anchor housing 24 and the hydraulic valve 28.

In one embodiment of the invention, the lanyard anchor housing 24 is positioned in one of the openings of the dash cover 62 of the set of upper boom controls 18. In another embodiment of the invention, the lanyard anchor housing 24 is positioned on the exterior segment 58 of the cavity 54 of the utility platform 16. In another embodiment, the lanyard anchor housing 24 is positioned on the interior segment 56 of the cavity 54 of the utility platform 16. In yet another embodiment of the invention, the lanyard anchor housing 24 is positioned on the bucket lip 60 of the utility platform 16. In still another embodiment of the invention, the lanyard anchor 22 is positioned on the bucket floor 52 of the utility platform 16, facing into the utility platform 16.

In other embodiments of the invention, discussed below, a plurality of lanyard anchor housings 24 is utilized, each of which is positioned in any or all of the above-mentioned positions, as shown in FIG. 11. Utilizing a plurality of lanyard anchor housings 24, each of which is operable to selectively provide power to the set of upper boom controls 18, is advantageous because the operator 46 would not be able to hold down all of the lanyard anchor housings 24 with the operator's hand and still have a free hand with which to operate the set of upper boom controls 18.

As shown in FIGS. 5 and 6 and in one embodiment of the invention, the lanyard anchor housing 24 comprises a button or knob 84 that presents a recess 86. In this embodiment, the lanyard anchor 22 is disposed within the recess 86 of the button or knob 84, and the lanyard anchor 22 becomes exposed such that the operator 46 could connect his lanyard 72 thereto upon the depression of the button or knob 84 with the operator's hand or the carabiner 78 of the lanyard 72. The lanyard anchor 22 is securely coupled to the utility platform 16, such that it can support at least the weight of the operator 46 upon a fall. The lanyard anchor 22 therefore, in this embodiment, does not move but instead the lanyard anchor housing 24 moves relative to the lanyard anchor 22.

Figure 12:
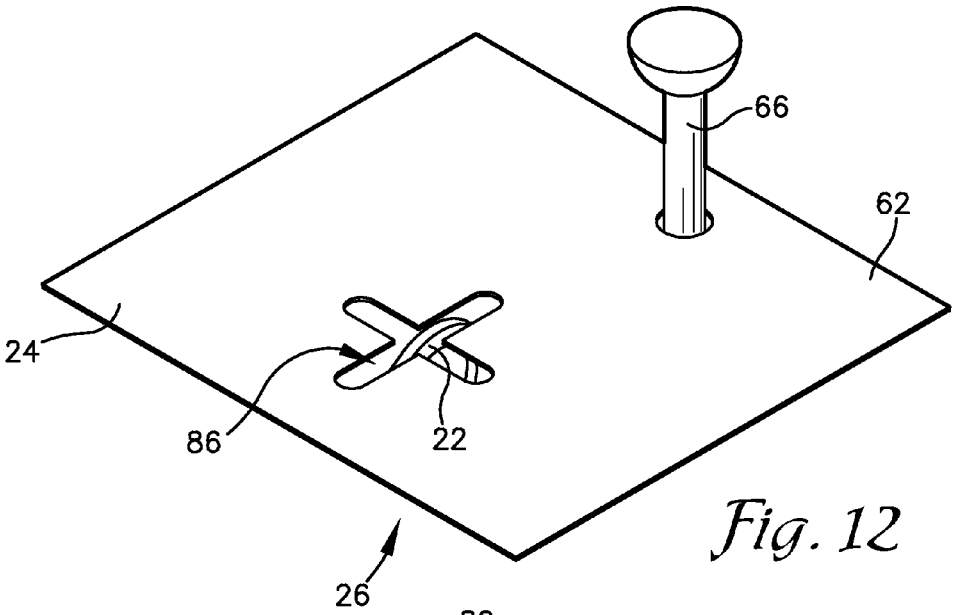
FIG. 12 is a perspective view of another embodiment of the lanyard interlock wherein the lanyard anchor housing is a dash cover, shown in the first position.
Figure 13:
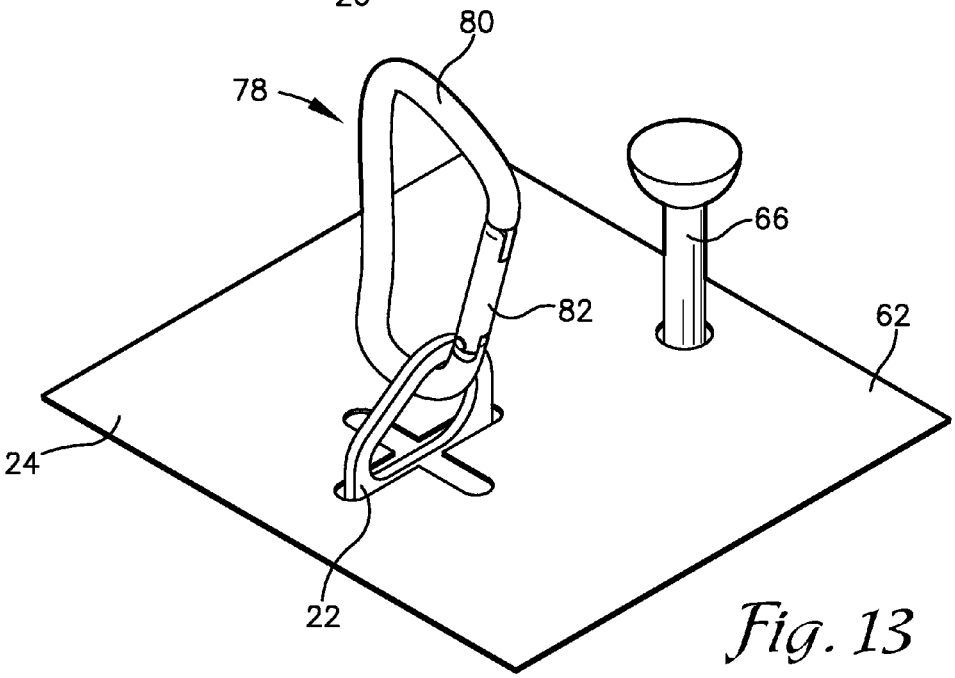
FIG. 13 is a perspective view of the lanyard interlock of FIG. 12 with the lanyard anchor exposed, and the carabiner of the lanyard attached.

In another embodiment of the invention, the lanyard anchor housing 24 is stationary and the lanyard anchor 22 moves relative to the lanyard anchor housing 24, as shown in FIGS. 12 and 13. As such, the lanyard anchor 22 is withdrawn from the lanyard anchor housing 24 to move the lanyard anchor housing 24 into the second position. In one embodiment, the lanyard anchor 22 is recessed into the lanyard anchor housing 24 such that operator's finger could not retrieve the lanyard anchor 22. In this embodiment, the lanyard anchor housing 24 may be the dash cover 62 of the set of upper boom controls 18, a segment of one of the four bucket sidewalls 50, or a segment of the bucket floor 52. In this embodiment, the operator 46 would be forced to use a tip of the carabiner 78 of the lanyard 72 to pull out the lanyard anchor 22. This embodiment provides the advantage of preventing the operator 46 from simply depressing the lanyard anchor housing 24 with his hand.

In embodiments of the invention, the lanyard anchor housing 24 acts as the valve handle 66 by directly altering the hydraulic valve position based upon the lanyard anchor housing 24 position. In other embodiments, the lanyard anchor housing 24 further comprises a linkage 88 for securely but movably connecting the lanyard anchor housing 24 to the valve handle 66. When the lanyard anchor housing 24 is in the first position, the hydraulic valve 28 is in a corresponding first position. When the lanyard anchor housing 24 is in the second position, the hydraulic valve 28 is in a corresponding second position. The hydraulic valve 28 is further discussed below.

In embodiments of the invention, the hydraulic valve 28 is further operable to be selectively positioned in a third position, known as an emergency stop 90. In the event the operator 46 wishes to cease power to the boom assembly 14, it may be dangerous for the operator 46 to detach the lanyard 72 from the lanyard anchor 22 to return the lanyard anchor housing 24 to the first position. To overcome this, embodiments of the invention provide a third position of the hydraulic valve 28. The operator 46 engages the emergency stop 90 by further depressing the valve handle 66 to place the hydraulic valve 28 into the third position. In the third position, the hydraulic valve 28 prevents the flow of hydraulic fluid to the set of upper boom controls 18.

The emergency stop 90 comprises a detent spool action 92. In a detent spool action, a valve remains in the position into which it is placed until physically removed by the operator 46. As such, when the operator 46 depresses the emergency stop 90, the emergency stop 90 remains depressed after the operator 46 removes his hand from the emergency stop 90. In embodiments, the operator 46 can then return the emergency stop 90 to the default position by pulling the emergency stop 90 to remove it from the depressed position. The detent spool action 92 differs from a spring center spool action 94, in which the valve returns to its default position absent an external force. The actuator 26 returns the lanyard anchor housing 24 to the first position upon the removal of the lanyard 72 and thus comprises the spring center spool action 94.

The actuator 26 of the lanyard interlock assembly 20 is in embodiments of the invention a spring 96 that linearly translates the lanyard anchor housing 24 relative to the lanyard anchor 22. In another embodiment, the actuator 26 linearly translates the lanyard anchor 22 relative to the lanyard anchor housing 24. The actuator 26 utilizes a power source that is mechanical, electrical, hydraulic, or pneumatic. The actuator 26 comprises the spring center spool action 94, discussed above, to return the lanyard interlock assembly 20 to the default position absent an external force. In one embodiment, the actuator 26 operates to selectively place the lanyard interlock assembly 20 into either of the first position and the second position. In another embodiment, the actuator 26 operates to selectively place the lanyard interlock assembly 20 into the first position, second position, or third position.

Extension of the spring 96 generates a force that pushes the lanyard anchor housing 24 into the first position. In another embodiment, the spring 96 generates a force that pushes the lanyard anchor 22 into the first position. In other embodiments of the invention, the actuator 26 comprises a hydraulic line 98 that generates a force due to hydraulic pressure that pushes the lanyard anchor housing 24 into the first position. In still another embodiment, this force is generated by a negative pressure that pulls the lanyard anchor housing 24 into the first position.

The hydraulic valve 28 selectively directs or blocks the flow of a hydraulic liquid through the hydraulic valve 28. The hydraulic liquid is a medium, such as water or oil, by which power is transferred. The hydraulic valve 28 has a plurality of positions into which it can be placed to accomplish a desire of the operator 46. The operator 46 places the hydraulic valve 28 into the various positions by the application of a force, directly or indirectly. While a few exemplary hydraulic valve configurations are shown in FIGS. 8-10, it should be appreciated that other valve configurations could be utilized to accomplish the task.

It should also be appreciated that while the term "hydraulic valve" is used for clarity, embodiments of the invention could, additionally or in the alternative, utilize pneumatic valves that control a pressurized gas instead of a hydraulic liquid.

Figure 8:
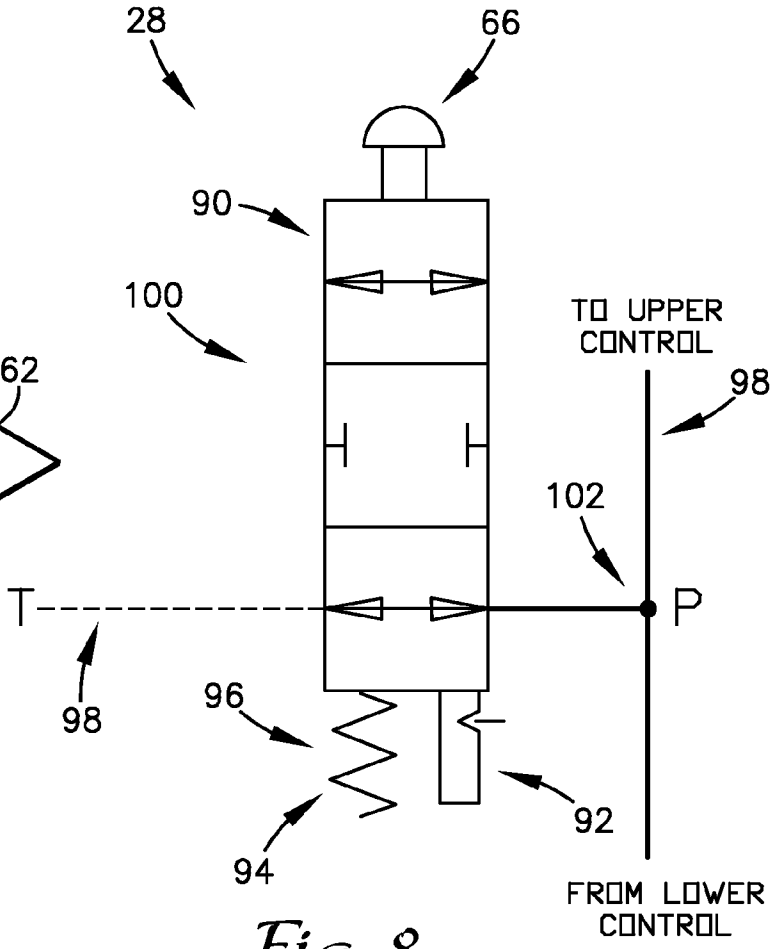
FIG. 8 is a hydraulic schematic of one embodiment of a three-position hydraulic valve controlled by the lanyard interlock.
Figure 7:
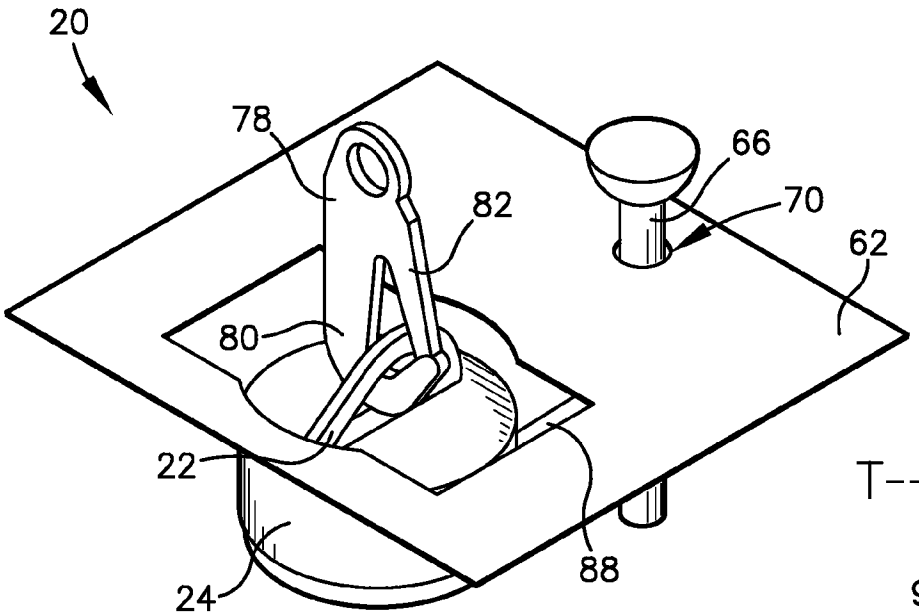
FIG. 7 is a perspective view of the lanyard interlock of FIG. 6, with a carabiner of the lanyard attached to the lanyard anchor.
Figure 10:
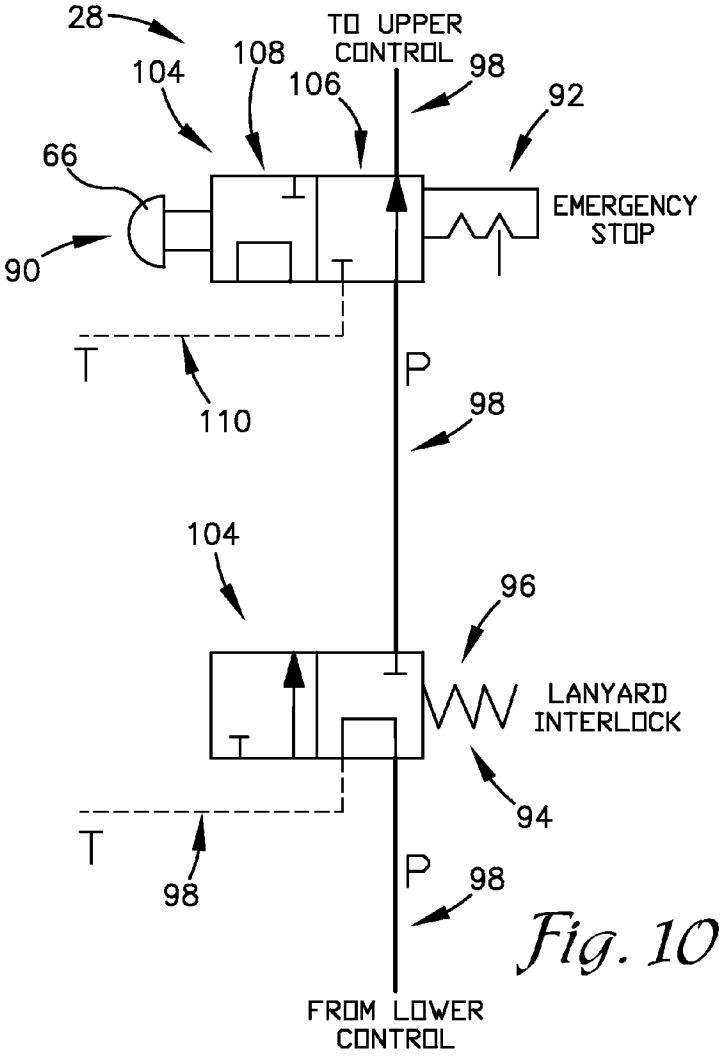
FIG. 10 is a hydraulic schematic of two two-position hydraulic valves.
Figure 9:
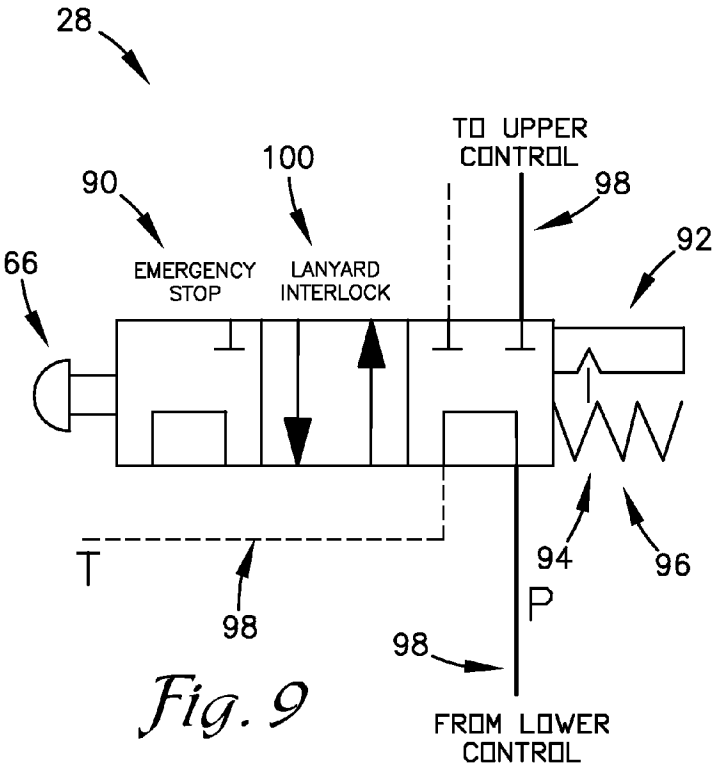
FIG. 9 is a hydraulic schematic of another embodiment of the three-position hydraulic valve.

In each of the exemplary embodiments illustrated in FIGS. 8-10, there are three external locations. The hydraulic fluid travels between these locations via at least one hydraulic line 98. The first of these external locations is a pressure from the set of lower boom controls 44. In another embodiment, not illustrated, the pressure could instead come directly from a motor. The second of these external locations is a tank. The tank is the return reservoir to which the hydraulic fluid is returned. The third external location is a pressure to the set of upper boom controls 18. The pressure to the set of upper boom controls 18 allows the set of upper boom controls 18 to manipulate the boom assembly 14.

In each of the exemplary embodiments illustrated in FIGS. 8-10, the hydraulic valve 28 is in an "open center" configuration. In an open center configuration, the pressure from the set of lower boom controls 44 is freely returned to the tank in the first position, which is the default position. In other alternative embodiments, the hydraulic valve 28 is in a "closed center" configuration. In a closed center configuration, the pressure from the set of lower boom controls 44 is blocked at the hydraulic valve 28 and not permitted to return to the tank. The exemplary hydraulic valve 28 embodiments laid out in FIGS. 8-10 will now be discussed.

In one embodiment of the invention, the hydraulic valve 28 comprises a three-position valve 100 as illustrated in FIG. 8. In this embodiment, the pressure from the set of lower boom controls 44 is directly in line with the pressure to the set of upper boom controls 18. However, there is a T-Intersection 102 coming off the direct hydraulic line 98 that leads to the hydraulic valve 28. In the first position, the hydraulic valve 28 allows the fluid to flow through the hydraulic valve 28 and return to the tank. In the first position, since the fluid is freely returning to the tank, there is not sufficient pressure to push the fluid up to and operate the set of upper boom controls 18. In the second position, the hydraulic valve 28 blocks the flow of fluid through the hydraulic valve 28. As such, there is sufficient pressure from the set of lower boom controls 44 to push the fluid up and operate the set of upper boom controls 18. In the third position, the hydraulic valve 28 allows the fluid to flow through the hydraulic valve 28 and return to the tank. As such, there is insufficient pressure to operate the set of upper boom controls 18.

In this embodiment, the hydraulic valve 28 is selectively placed in the first position by the actuator 26. In this embodiment, the hydraulic valve 28 is placed into the second position by the operator 46 depressing the lanyard anchor housing 24, which depresses the linkage 88. The hydraulic valve 28 remains in the second position so long as the lanyard anchor housing 24 is depressed, such as by the attachment of the lanyard 72 to the exposed lanyard anchor 22. Upon the removal of the lanyard 72 from the lanyard anchor 22, the actuator 26 returns the lanyard anchor housing 24 to the first position via the spring center spool action 94. In one embodiment, the operator 46 places the hydraulic valve 28 in the third position by depressing the emergency stop 90. The hydraulic valve 28 remains in the third position via the detent spool action 92. The operator 46 may then return the second position by raising the emergency stop 90 to its original position.

In another embodiment of the invention, the hydraulic valve 28 comprises the three-position valve 100 illustrated in FIG. 9. In this embodiment, the hydraulic valve 28 returns the pressure from the set of lower boom controls 44 to the tank in the first position, which is the default position. In this open center configuration, the fluid freely flows through the hydraulic valve 28 and returns to the tank. Upon the placement of the lanyard interlock into the second position, by the attachment of the lanyard 72, the hydraulic valve 28 is configured to allow the flow of hydraulic fluid through the hydraulic valve 28 to the set of upper boom controls 18. A return line from the set of upper boom controls 18 allows the hydraulic fluid to flow back through the hydraulic valve 28 and return to the tank. When the emergency stop 90 is engaged and the hydraulic valve 28 is placed into the third position, the pressure from the set of lower boom controls 44 is again allowed to freely return through the hydraulic valve 28 back to the tank.

In this embodiment, the hydraulic valve 28 is selectively placed in the first position by the actuator 26 and is placed into the second position by the operator 46 depressing the lanyard anchor housing 24, which in turn depresses the linkage 88. The hydraulic valve 28 remains in the second position so long as the lanyard anchor housing 24 is depressed, such as by the attachment of the lanyard 72 to the exposed lanyard anchor 22. Upon the removal of the lanyard 72 from the lanyard anchor 22, the actuator 26 returns the lanyard anchor housing 24 to the first position. In this embodiment, the operator 46 places the hydraulic valve 28 in the third position by depressing the emergency stop 90. The hydraulic valve 28 remains in the third position via the detent spool action 92. The operator 46 may then return to the second position by raising the emergency stop 90 to its original position.

In yet another embodiment of the invention, the operator safety system 10 comprises two two-position valves 104 as illustrated in FIG. 10 and labeled a lanyard interlock hydraulic valve and an emergency stop hydraulic valve. In this embodiment, the lanyard interlock hydraulic valve and the emergency stop hydraulic valve are separate and distinct units. The hydraulic fluid passes though both the lanyard interlock hydraulic valve and the emergency stop hydraulic valve individually before reaching the set of upper boom controls 18. When the lanyard interlock is in the first position, the pressure from the set of lower boom controls 44 is allowed to freely return to the tank. When the lanyard interlock is in the second position, the hydraulic fluid is allowed to flow through the lanyard interlock hydraulic valve to the emergency stop hydraulic valve. When the emergency stop hydraulic valve is in an unengaged position 106, as illustrated in FIG. 10, the hydraulic fluid is allowed to freely flow to the set of upper boom controls 18. When the emergency stop hydraulic valve is placed into an engaged position 108, the hydraulic fluid is forced to return to the tank via a separate hydraulic line 110. This embodiment provides the advantage of allowing the lanyard interlock assembly 20 and the emergency stop 90 to be positioned away from each other.

In yet further embodiments of the invention, the operator safety system 10 illustrated in FIG. 10 comprises a second lanyard interlock hydraulic valve (not illustrated). In this embodiment, the second lanyard interlock hydraulic valve is substantially similar to the lanyard interlock hydraulic valve illustrated in FIG. 10. In this embodiment, the hydraulic fluid passes through the lanyard interlock hydraulic valve and through the second lanyard interlock hydraulic valve before arriving at the emergency stop hydraulic valve. In the unengaged position 106, the hydraulic fluid passes through the emergency stop hydraulic valve to power the set of upper boom controls 18. The set of upper boom controls 18 only receives power if the lanyard interlock is in the second position, if the second lanyard interlock is in the second position, and if the emergency stop 90 is in the first position. This embodiment provides the advantage of preventing the operator 46 from holding down the lanyard interlock and the second lanyard interlock with his hand, while having a free hand to operate the set of upper boom controls 18, see FIG. 11.

In embodiments of the invention, the lanyard interlock assembly 20 is adapted to be added to existing utility platforms 16 and aerial devices 42. In other embodiments, the lanyard interlock assembly 20 is adapted to be added to existing utility platforms 16 and utilize the existing lanyard anchors 22 already within the utility platforms 16. In still other embodiments of the invention, the lanyard interlock assembly 20 is adapted to be originally manufactured with the boom assembly 14 or aerial device 42.

Embodiments of the invention relate to a method of ensuring operator safety. In embodiments of the invention, the method comprises the steps of obtaining the aerial device 42 comprising the boom assembly 14, the utility platform 16, and at least one lanyard interlock assembly 20; obtaining the lanyard 72; securely coupling the lanyard 72 to the operator 46; securing the lanyard 72 to the at least one lanyard interlock assembly 20; keeping the lanyard secured to the at least one lanyard interlock assembly 20 during the operation of the utility platform 16; and disconnecting the lanyard 72 from the lanyard interlock assembly 20 only upon the operator 46 returning the boom assembly 14 to a position adjacent to the ground.

As the operator 46 secures the lanyard 72 to the at least one lanyard interlock assembly, the operator 46 depresses the lanyard anchor housing 24. Depressing the lanyard anchor housing 24 shifts the hydraulic valve 28 to the second position because the lanyard anchor housing is attached via the linkage 88 to the hydraulic valve 28. In the second position, the hydraulic valve 28 allows the flow of hydraulic fluid through the hydraulic lines 98 to the set of upper boom controls 18. The operator 46 secures the lanyard 72 to the lanyard anchor 22 by opening the gate 82 of the carabiner 78 and emplacing the ring 80 of the carabiner 78 through the lanyard anchor 22. The operator 46 then securely closes the carabiner 78. The thickness of the carabiner 78 prevents the lanyard anchor housing 22 from returning to the first position. Upon the completion of the work, the operator 46 removes the carabiner 78 of the lanyard 72 by opening the gate 82 and withdrawing the ring 80 of the carabiner 78. With the lanyard 72 removed, the actuator 26, which has been placing a force on the lanyard anchor housing 24, returns the lanyard anchor housing 24 to the first position. This is due to the spring center spool action 94 configuration of the lanyard interlock assembly 20.

In other embodiments of the invention, the method further comprises the step of engaging the emergency stop 90 upon the discovery of an unsafe operating environment. The emergency stop 90 further depresses the hydraulic valve 28 into the third position, in which the hydraulic valve 28 again restricts the flow of hydraulic fluid to the set of upper boom controls 18. Typically, the operator 46 engages the emergency stop 90 by depressing a valve handle 66 located on the dash cover 62 of the set of upper boom controls 18. After the emergency stop 90 has been engaged, it will remain engaged via the detent spool action 92 until the operator 46 or other person disengages the emergency stop 90.

In still other embodiments of the invention, the method comprises installing the lanyard interlock assembly 20 into an existing aerial device 42 or utility platform 16. In one embodiment of the invention, the method comprises cutting of a hydraulic line 98 in or near the utility platform 16, securely coupling of the lanyard anchor 22 to a segment of the utility platform 16, installing the hydraulic valve 28 in the cut hydraulic line 98, installing of the lanyard anchor housing 24 around the lanyard anchor 22, and testing of the lanyard interlock assembly 20 to ensure appropriate function.

In yet further embodiments of the invention, the method further comprises the steps of performing a job or task while secured to the lanyard interlock assembly 20. The operator 46, having secured himself to the lanyard interlock assembly 20 as discussed above, operates the set of upper boom controls 18 to position the utility platform 16 from a starting position adjacent to the ground into a desired location or orientation. The operator 46 then performs a job or task while standing in the utility platform 16. The job or task could include, but is not limited to, installing equipment, repairing equipment, uninstalling equipment, testing equipment, clearing a power line, maintaining trees and other vegetation, installing utility poles, moving a load, rescuing a stranded person, extinguishing a fire, recording a video, taking a photograph, and observing or supervising a task or job performed by others. The utility worker 46 may then perform additional jobs or tasks, which may include moving the utility platform 16 into a different location or orientation. Upon the completion of all tasks or jobs, the utility worker 46 returns the utility platform 16 to the position adjacent to the ground via the set of upper boom controls 18. It should also be noted that the assistant operator at the set of lower boom controls 44 could perform some or all of the movement of the utility platform 16.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A machine operator safety system for selectively providing hydraulic power to a boom assembly of an aerial device, the system comprising:

a set of upper boom controls disposed in a utility platform that are operable to move the boom assembly via hydraulic power, wherein the utility platform is disposed at a distal end of said boom assembly;

a lanyard anchor housing operable to be selectively positioned to a default first position and a second manually actuated position;

a lanyard anchor housed within the lanyard anchor housing;

an actuator configured to selectively position the lanyard anchor housing in either of the first or second positions, said default first position of the lanyard anchor housing concealing the anchor to prevent attachment of a lanyard by an operator, said second manually actuated position of the lanyard anchor housing exposing the anchor for attachment of the lanyard by the operator; and a hydraulic valve configured to selectively provide hydraulic power to the set of upper boom controls only while the lanyard anchor housing is in the second position.

2. The machine operator safety system of claim 1, wherein the lanyard comprises a harness adapted to be securely coupled to the operator, a safety line securely coupled to the harness, and a carabiner adapted to selectively and securely couple to the lanyard anchor.

3. The machine operator safety system of claim 1, wherein the lanyard anchor housing is positioned into the second position by the operator depressing the lanyard anchor housing.

4. The machine operator safety system of claim 1, wherein the lanyard anchor housing is positioned into the second position by the operator withdrawing the lanyard anchor from within the lanyard anchor housing.

5. The machine operator safety system of claim 1, further comprising:

a linkage securely coupled to the lanyard anchor housing and to the hydraulic valve, wherein the linkage places the hydraulic valve into a first valve position when the lanyard anchor housing is in said first position, wherein the linkage places the hydraulic valve into a second valve position when the lanyard anchor housing is in said second position, said first valve position directing a flow of hydraulic fluid to a tank, said second valve position directing the flow of hydraulic fluid to said set of upper boom controls.

6. The machine operator safety system of claim 5, further comprising an emergency stop.

7. The machine operator safety system of claim 6, wherein the emergency stop comprises:

a valve handle adapted to be selectively engaged by the operator, a third valve position adapted in a detent spool action, said third valve position directing the flow of hydraulic fluid to the tank.

8. The machine operator safety system of claim 6, wherein the emergency stop is separated from the lanyard anchor housing and comprises:

a valve handle adapted to be selectively engaged by the operator, an emergency stop valve having an unengaged position and an engaged position, said unengaged position directing the flow of hydraulic fluid to the set of upper boom controls, said engaged position directing the flow of hydraulic fluid to the tank and comprising a detent spool action.

9. A lanyard interlock assembly for installing in a utility platform of an aerial device to selectively provide hydraulic power to a boom of the aerial device, the lanyard interlock assembly comprising:

a lanyard anchor housing operable to be selectively positioned to a default first position and a second manually actuated position;

a lanyard anchor housed within the lanyard anchor housing;

an actuator configured to selectively position the lanyard anchor housing in either of the first position or the second position, said default first position of the housing concealing the anchor to prevent attachment of a lanyard by the operator, said second manually actuated position of the housing exposing the anchor for attachment of the lanyard by an operator; and a hydraulic valve configured to selectively provide hydraulic power to a set of upper boom controls.

10. The lanyard interlock assembly of claim 9, wherein the lanyard anchor housing is positioned into the second position by the operator depressing the lanyard anchor housing.

11. The lanyard interlock assembly of claim 9, wherein the lanyard anchor housing is position into the second position by the operator withdrawing the lanyard anchor from within the lanyard anchor housing.

12. The lanyard interlock assembly of claim 9, further comprising:

a linkage securely coupled to the lanyard anchor housing and to the hydraulic valve, wherein the linkage places the hydraulic valve into a first valve position when the lanyard anchor housing is in said first position, wherein the linkage places the hydraulic valve into a second valve position when the lanyard anchor housing is in said second position, said first valve position directing a flow of hydraulic fluid to a tank, said second valve position directing the flow of hydraulic fluid to said set of upper boom controls.

13. The lanyard interlock assembly of claim 12, further comprising an emergency stop.

14. The lanyard interlock assembly of claim 13, wherein the emergency stop comprises:

a valve handle adapted to be selectively engaged by the operator, a third valve position adapted in a detent spool action, said third valve position directing the flow of hydraulic fluid to the tank.

15. The lanyard interlock assembly of claim 13, wherein the emergency stop is separated from the lanyard anchor housing and comprises:

a valve handle adapted to be selectively engaged by the operator, an emergency stop valve having an unengaged position and an engaged position, said unengaged position directing the flow of hydraulic fluid to the set of upper boom controls, said engaged position directing the flow of hydraulic fluid to the tank and comprising a detent spool action.

16. A method of ensuring that an operator utilizing a utility platform coupled to a boom assembly of an aerial device is safe, the method comprising the steps of:

obtaining at least one lanyard interlock assembly of claim 9 in the utility platform, wherein the at least one lanyard interlock assembly is adapted to selectively provide hydraulic power to the boom assembly;

securing the lanyard to the operator;

securing the lanyard to the at least one lanyard interlock assembly;

keeping the lanyard secured to the at least one lanyard interlock assembly during the operator's operation of the utility platform; and disconnecting the lanyard from the lanyard interlock assembly upon the operator returning the boom assembly to a position adjacent to the ground.

17. The method of claim 16, further comprising the step of obtaining the lanyard, wherein the lanyard comprises a harness, a safety line, and a carabiner.

18. The method of claim 16, further comprising the step of:

depressing an emergency stop upon the discover of an unsafe operating environment.

19. The method of claim 16, further comprising the step of:

installing the lanyard interlock assembly into the utility platform.

20. The method of claim 19, further comprising the steps of:

cutting a hydraulic line in or near the utility platform;

securely coupling the lanyard interlock assembly to the utility platform;

installing a hydraulic valve into the cut hydraulic line; and testing of the lanyard interlock assembly to ensure functionality.

* * * * *

UNITED STATES PATENT AND TRADEMARK OFFICE

CERTIFICATE OF CORRECTION

PATENT NO. : 9,149,670 B1
APPLICATION NO. : 14/485044
DATED : October 6, 2015
INVENTOR(S) : Walker et al.

It is certified that error appears in the above-identified patent and that said Letters Patent is hereby corrected as shown below:

On the title page item [75],

Should read

Benjamin G. Southern

Signed and Sealed this
Twenty-second Day of March, 2016

Michelle K. Lee

Michelle K. Lee
*Director of the United States Patent and Trademark Office*